United States Patent [19]

Harper, Jr.

[11] 3,981,259

[45] Sept. 21, 1976

[54] CATAMARAN WITH EXTENSIBLE HULLS

[76] Inventor: William H. Harper, Jr., 5125 Lake Wheeler Road, Raleigh, N.C. 27603

[22] Filed: July 7, 1975

[21] Appl. No.: 593,480

[52] U.S. Cl. ..... 114/61; 114/123

[51] Int. Cl.[2] ..... B63B 1/00

[58] Field of Search ..... 114/61, 66.5 F, 123; 9/1 T

[56] References Cited

UNITED STATES PATENTS

| | | | |
|---|---|---|---|
| 1,705,303 | 3/1929 | Nagy | 114/123 |
| 2,678,018 | 5/1954 | Crisp | 114/123 |
| 3,787,910 | 1/1974 | Taylor | 114/61 |
| 3,860,982 | 1/1975 | Rumsey | 114/66.5 F |

*Primary Examiner*—Trygve M. Blix
*Assistant Examiner*—Jesus D. Sotelo
*Attorney, Agent, or Firm*—Herbert E. Haynes, Jr.

[57] ABSTRACT

A boat of the catamaran type having the usual superstructure mounted on a frame mechanism to which a pair of spaced parallel hulls are pivotably mounted. The frame mechanism includes an actuatable extension apparatus which simultaneously pivots the hulls in laterally opposite directions from a retracted position to a midposition to an extended position to provide the boat with changeable characteristics suitable for various boat operating modes.

12 Claims, 8 Drawing Figures

CATAMARAN WITH EXTENSIBLE HULLS

BACKGROUND OF THE INVENTION

1. Field of the Invention

This invention relates to boats and more particularly to a boat of the catamaran type having laterally extensible hulls.

2. Description of the Prior Art

It is well known that hull type and design is the primary factor which determines a boat's characteristics and those characteristics dictate the most efficient operating mode of a particular type of boat. For example, a flat bottom boat and a canoe have entirely different hull configurations, entirely different characteristics, and the efficient usages thereof are entirely different. Therefore, many basic boat designs have been developed to suit the various requirements of the various types of boat usages, and to the best of my knowledge, no prior art structure has been devised, or is readily adaptable for efficient operation in a plurality of such usages.

Boats of the catamaran type are well known for their desirable handling characteristics such as high speed operation, stability, and the like. Such boats often cannot be trailered due to the beam dimension thereof exceeding the legal limits relating to transporting over highways, and this same beam dimension often presents problems in dry land storage. In attempts to solve this problem, several devices have been devised to provide a catamaran boat with retractable hulls. In general, these prior art retractable hull catamarans are a two position structure, i.e., a retracted position for storage and trailering and an extended position for use in the water. Thus, these retractable hull catamarans have a single set of characteristics relating to water usage with the retractable feature being designed for solving a dry land problem. It is further believed that none of these prior art retractable hull catamarans are designed for or are capable of being retracted or extended while the boat is in the water to alter the characteristics of the boat.

SUMMARY OF THE INVENTION

In accordance with the present invention, a new and improved boat structure of the catamaran type is disclosed as having a frame mechanism upon which any conventional type of superstructure may be supported. A pair of spaced parallel hulls are pivotably mounted on opposite sides of the frame mechanism and an actuatable extension mechanism is employed to pivotably move the hulls. The extension mechanism will simultaneously move the hulls from a retracted position to a midposition to a fully extended position upon actuation thereof, and such movements may be accomplished while the boat is in the water. The fully retracted position is ideal for trailering, storage, and the like and may also be employed for in water use as the beam dimension in the retracted position is approximately equal to that of a conventional boat of comparable size. The midposition of the hulls is ideally suited for high speed operation as this position achieves all the desirable characteristics of a conventional catamaran. The fully extended position of the hulls adapts the boat structure of the present invention for shallow draft operation of outstanding stability and also provides additional deck space.

Accordingly, it is an object of the present invention to provide a new and improved boat structure.

Another object of the present invention is to provide a new and improved boat structure of the catamaran type having extensible hulls.

Another object of the present invention is to provide a new and improved boat structure of the catamaran type having a pair of spaced parallel hulls which are pivotably movable from a retracted position to a midposition to a fully extended position to alter the characteristics thereof so that the boat may be efficiently employed in various types of boat operating modes.

Another object of the present invention is to provide a new and improved boat structure having a frame mechanism upon which a suitable superstructure is mounted and having a pair of spaced parallel hulls pivotably mounted thereon, and frame mechanism having an extension mechanism for extending and/or retracting the hulls.

Still another object of the present invention is to provide a boat structure of the above described character having the hull extension mechanism thereof configured as a two stage device which moves the hulls from the retracted position to the midposition by a first movement providing means and to move the hulls from the midposition to the fully extended position by a second movement providing means.

The foregoing and other objects of the present invention as well as the invention itself may be more fully understood from the following description when read in conjunction with the accompanying drawings.

DESCRIPTION OF THE PREFERRED EMBODIMENT

Figure 1:
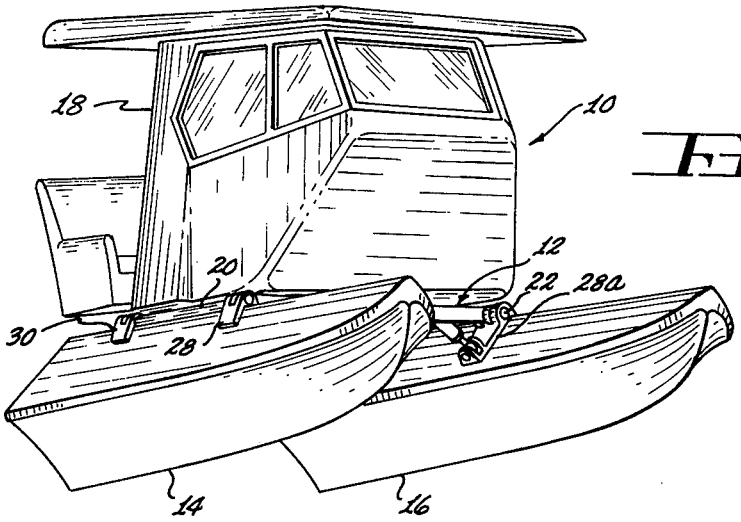
FIG. 1 is a perspective view of a boat structure which includes the features of the present invention.

Referring more particularly to the drawings, FIG. 1 illustrates a boat structure of the type sometimes referred to as a catamaran and which is indicated generally by the reference numeral 10. As shown, the boat 10 includes a frame mechamism 12 having a pair of spaced parallel hulls or pontoons 14 and 16 mounted thereon as will hereinafter be described in detail. The boat 10 also includes a suitable superstructure 18 mounted atop the frame mechanism 12, and it should be noted that the particular superstructure shown is not intended as a limitation to the present invention, as any type of superstructure may be considered as a functional equivalent.

Figure 2:
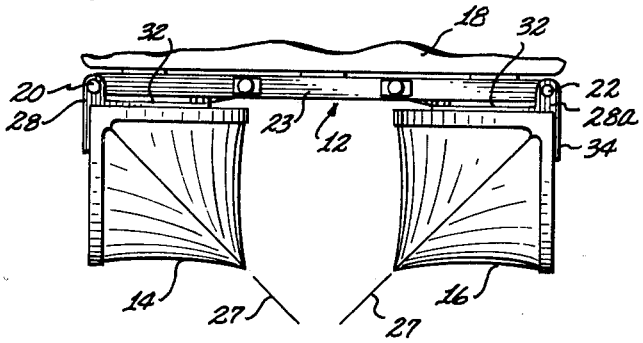
FIG. 2 is a fragmentary front elevation of the apparatus of the present invention which shows the retracted position of the hulls thereof.
Figure 3:
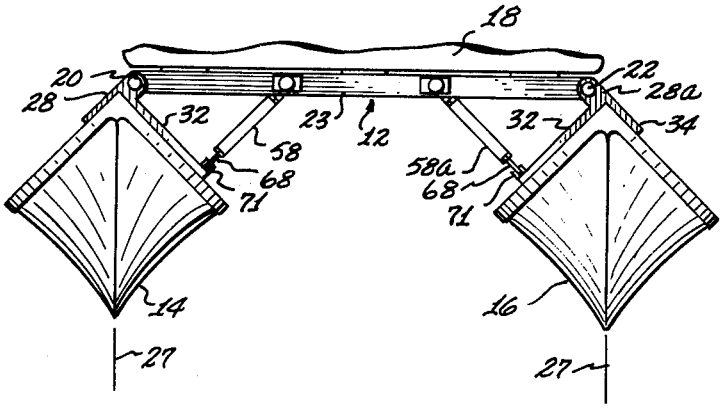
FIG. 3 is a view similar to FIG. 2 which shows the midposition of the hulls.
Figure 4:
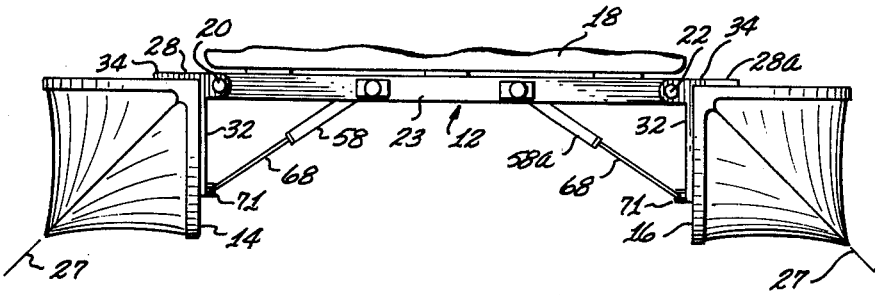
FIG. 4 is a view similar to FIGS. 2 and 3 and which shows the fully extended position of the hulls.

FIGS. 2, 3, and 4 illustrate the three positions of the laterally extensible hulls 14 and 16 which alter the characteristics of the boat 10 to suit particular boating requirements as now will be described in detail.

FIG. 2 illustrates the extensible hulls 14 and 16 in the retracted position which is ideal for trailering, dry land storage, and the like due to the minimum beam dimension of the boat. This retracted position of the hulls 14 and 16 may also be employed when the boat 10 is in the water and will result in characteristics similar to a conventional boat as the beam dimension is approximately equal to a conventional boat of comparable size.

In FIG. 3, it will be seen that the extensible hulls 14 and 16 have been moved, as will hereinafter be described in detail, to a midposition thereof which provides the boat 10 with the well known characteristics of a catamaran.

FIG. 4 shows the extensible hulls 14 and 16 in the fully extended position which, due to the greatly increased beam width, results in an increase in the boat's stability and also results in the boat 10 being ideally suited for shallow draft operation. The fully extended hull position provides an additional feature in that a substantial increase in usable deck space is achieved which may be used for fishing, sun bathing, and the like.

Figure 5:
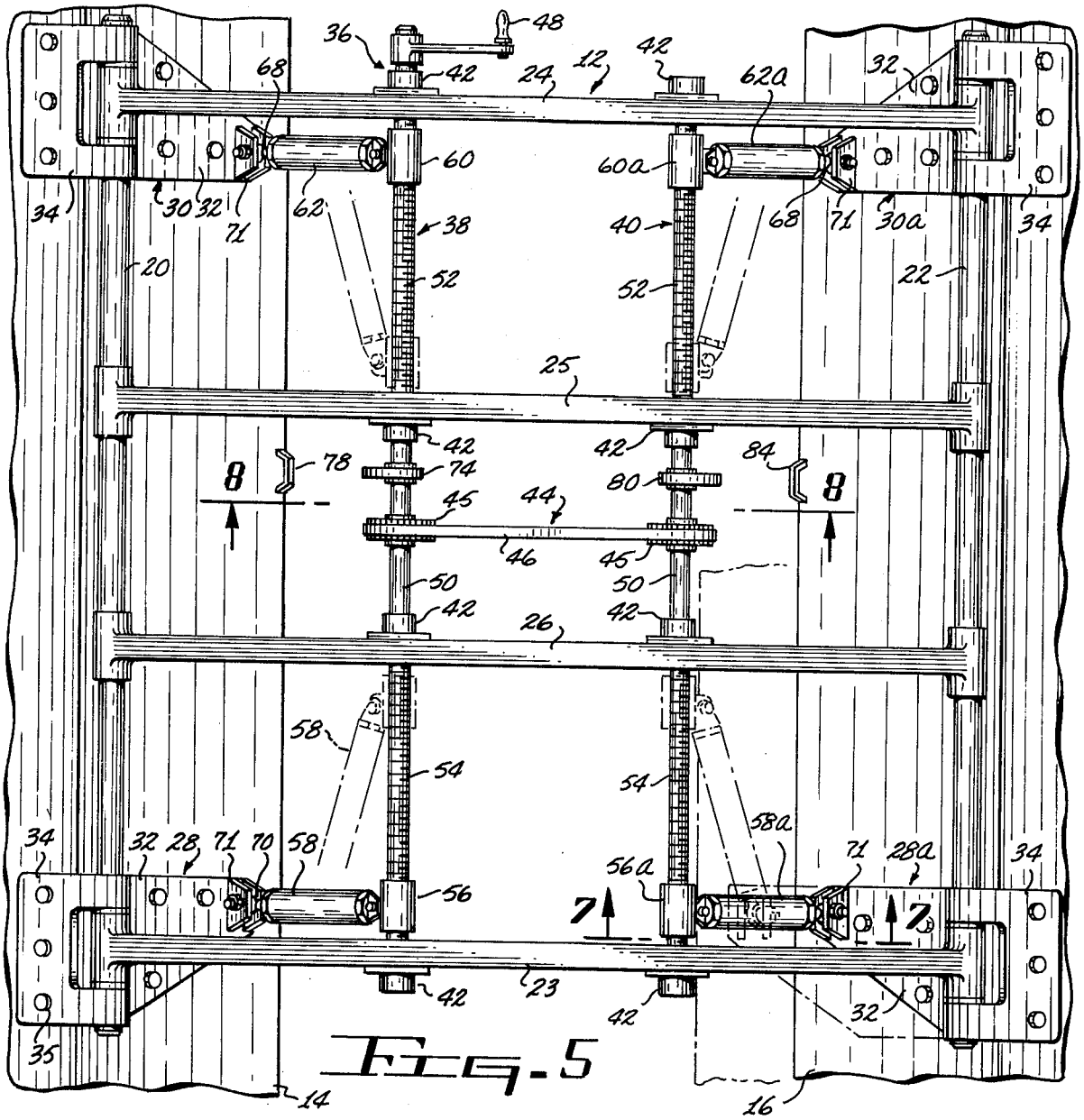
FIG. 5 is a plan view of the frame mechanism which includes the actuatable hull extension apparatus.

As hereinbefore mentioned, the hulls 14 and 16 are mounted on the frame mechanism 12 which, as best seen in FIG. 5, includes a pair of spaced parallel cylindrical shafts 20 and 22 which are disposed to extend longitudinally of the boat 10. The shafts 20 and 22 are fixedly interconnected by a transverse forward beam 23, a similar aft beam 24 and a spaced pair of similar intermediate beams 25 and 26. The hull 14 is mounted on the shaft 20 so as to be pivotable about the longitudinal axis thereof, and the hull 16 is similarly mounted on the shaft 22.

Each movement of the laterally extensible hulls 14 and 16 from the retracted positions to the midpositions, and from the midpositions to the fully extended positions requires that the hulls be rotated approximately 45° about their respective shafts 20 and 22. To illustrate this point, reference is made once again to FIGS. 2, 3, and 4 wherein there is shown a plane 27 which extends longitudinally of each of the hulls 14 and 16 and bisects those hulls. In the retracted position of the hull 14 and 16, as shown in FIG. 2, the planes 27 are inwardly angularly disposed at approximately 45° from the vertical. Movement of the hulls 14 and 16 from the retracted position to the midposition thereof as shown in FIG. 3 has moved the planes 27 through approximately 45° of rotation so that the planes are now vertically disposed. Further movement of the hulls 14 and 16 from the midposition to the fully extended position thereof as shown in FIG. 4 has moved those planes 27 another approximate 45° of rotation so that the planes are disposed angularly outwardly at approximately 45° from the vertical.

The hull 14 is pivotably connected to the shaft 20 by means of a forward bell crank 28 and an aft bell crank 30 which are journaled to rotate about the shaft 20 at the opposite ends thereof. The hull 16 is similarly mounted on the shaft 22 by a forward bell crank **28*a* and an aft bell crank 30*a*. Each of the bell cranks 28, 28*a*, 30 and 30*a* have an inboard arm 32 and an outboard arm 34 which are suitably affixed to their respective ones of the hulls 14 and 16 such as with bolts 35**.

The hereinbefore described laterally extensible movement of the hulls 14 and 16 is accomplished by a two stage actuatable hull extension means which is indicated generally by the reference numeral 36 in FIG. 5. The hull extension means 36 includes a pair of jackscrews 38 and 40 which are disposed to extend longitudinally of the boat 10 and are inwardly spaced and parallel with respect to the shafts 20 and 22. The jackscrews 38 and 40 are journaled for rotation in suitable bearings 42 carried in the beams 23, 24, 25 and 26 of the frame mechanism 12. The jackscrews 38 and 40 are interconnected, such as intermediate their opposite ends, with synchronizing means 44 which is employed to assure that the rotation of the jackscrews is synchronized. The synchronizing means 44 includes an axialy grooved pulley 45 on each of the jackscrews 38 and 40 with those pulleys 45 being transversely aligned with each other so that a toothed belt 46 passes over the pulleys. It should be obvious that the synchronizing means 44 may take the form of other well known devices such as a chain sprocket mechanism (not shown), a gear train (not shown) and the like.

The jackscrews 38 and 40 may be rotatably driven by any suitable actuating mechansim such as the hand operated crank 48 which is connected to the rearwardly extending end of the jackscrew 38 (FIG. 5), or any other well known drive means such as an electric motor (not shown). It will be noted that operation of the hand crank 48 will rotationally drive the jackscrew 38 and that rotary motion will be synchronously transmitted to the jackscrew 40 by means of the synchronizing means 44.

As shown in FIG. 5, each of the jackscrews 38 and 40 have a centrally located unthreaded portion 50 which is disposed to extend between the intermediate beams 25 and 26 of the frame mechanism 12. The jackscrews 38 and 40 each also have an aft screw threaded portion 52 with the aft portions 52 extending between the intermediate beam 25 and the aft beam 24 of the frame mechanism 12. The jackscrews 38 and 40 are each also provided with forward screw threaded portions 54 with those forward portions 54 extending between the intermediate beam 26 and the forward beam 23 of the frame mechanism 12.

The forward screw threaded portion 54 of the jackscrew 38 has an internally screw threaded nut 56 mounted thereon which, as will hereinafter be described in detail, is coupled to the inboard arm 32 of the forward bell crank 28 by a hydraulic cylinder 58, or other suitable longitudinally extendable means, and the aft screw threaded portion 52 of the jackscrew 38 has an internally screw threaded nut 60 mounted thereon which is coupled to the inboard arm 32 of the aft bell crank 30 by a hydraulic cylinder 62, or other suitable longitudinally extendable means. Similarly, the forward screw threaded portion 54 of the jackscrew 40 has an internally screw threaded nut **56*a* mounted thereon which is coupled by the hydraulic cylinder 58*a*, or other longitudinally extendable means, to the inboard arm 32 of the forward bell crank 28*a*, and the aft screw threaded portion 52 of the jackscrew 40 has the internally screw threaded nut 60*a* mounted thereon which is coupled by means of the hydraulic cylinder 62*a*, or other longitudinally extendable means, to the inboard arm 32 of the aft bell crank 30*a***.

Each of the nuts 56, **56*a*, 60, and 60*a* operate in the same manner and are coupled to their respective bell cranks 28, 28*a*, 30 and 30*a* in the same manner, therefore, the following detailed description of the nut 56*a*, hydraulic cylinder 58*a*, and bell crank 28*a*** will be understood to apply to all such assemblies.

Figure 7:
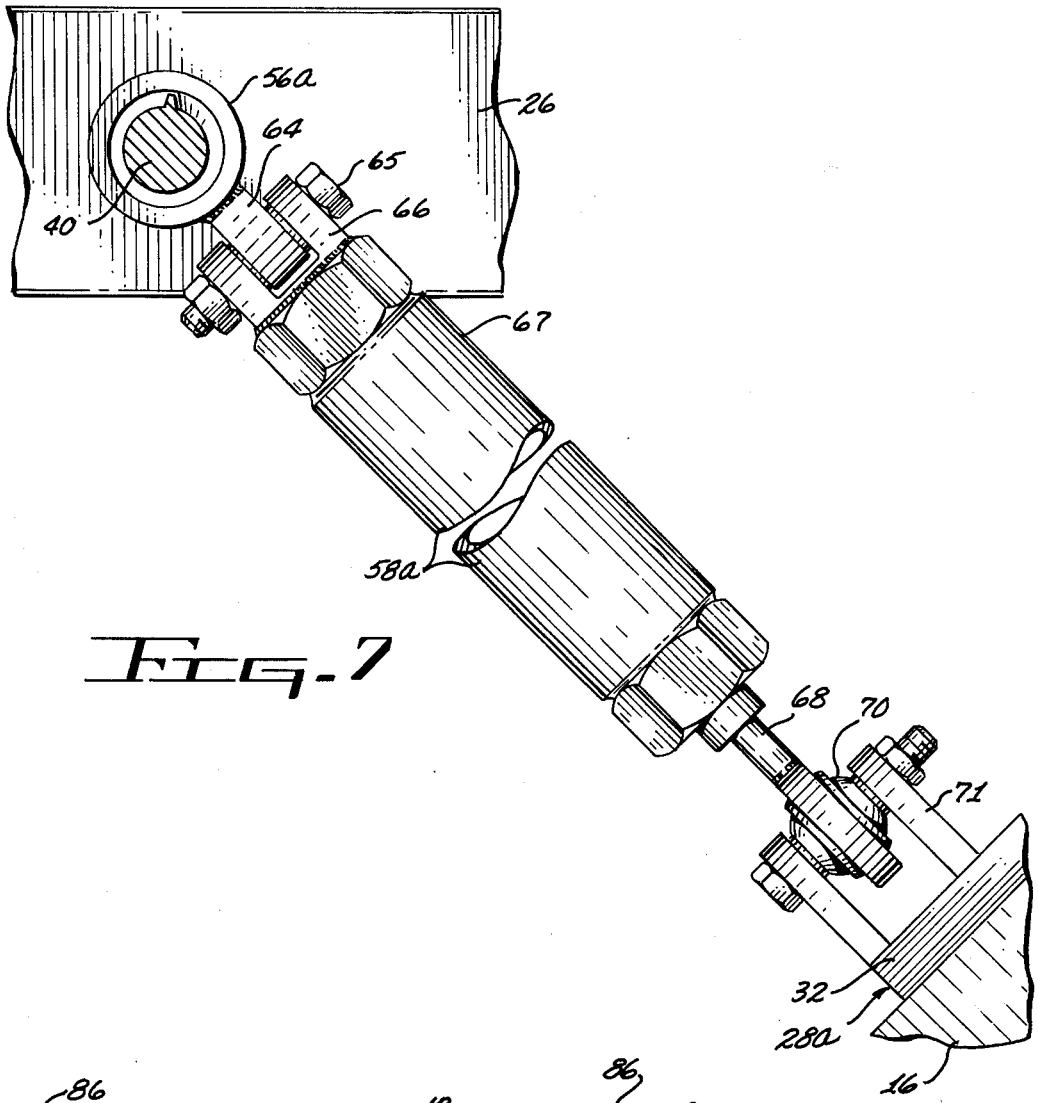
FIG. 7 is an enlarged fragmentary sectional view taken on the line 7—7 of FIG. 5.

As best seen in FIG. 7, the nut 56*a* is provided with a laterally extending tongue 64 which is pivotably connected such as by a suitable bolt 65 to the clevis 66 formed on the housing 67 of the hydraulic cylinder 58*a*. The hydraulically extendable piston rod 68 of the cylinder 58*a* is connected by means of a ball swivel joint 70 to a clevis 71 provided on the inboard arm 32 of the forward bell crank 28*a*. With the internally screw threaded nut 56*a* connected as described above, it will be readily apparent that the nut will be held against rotation and will therefore travel along the length of the screw threaded portion 54 of the jackscrew 40 when that jackscrew is rotatably driven.

Figure 6:
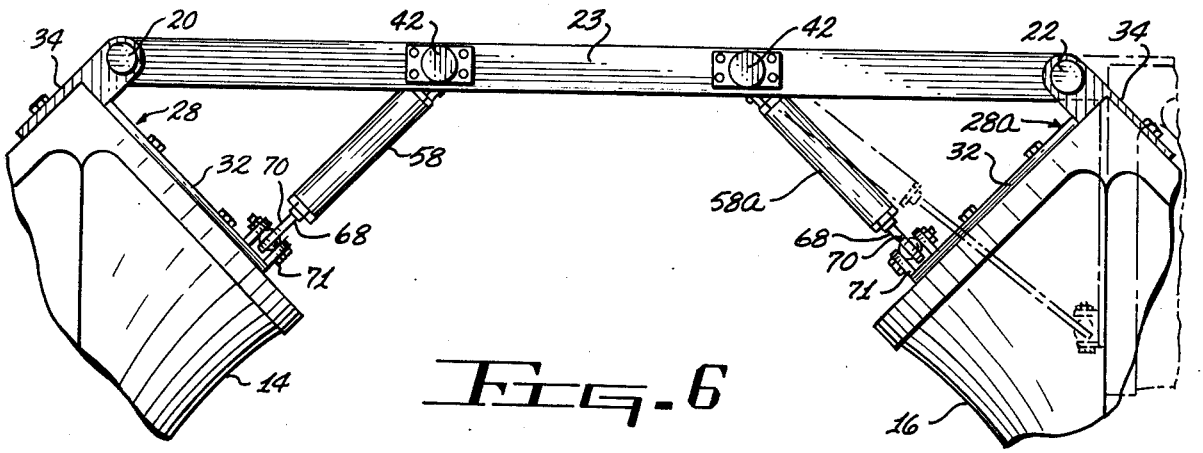
FIG. 6 is a front elevation of the frame mechanism and the actuatable hull extension apparatus.

When the nut 56*a* is at the forwardmost point of its travel, i.e., adjacent the forward beam 23 of the frame 12, and the hydraulic cylinder 58*a* is in the retracted or nonactuated position, the hull 16 will be positioned in its midposition as shown in FIGS. 1, 3, 5, and 6. It will be noted that in this midposition of the hull 16, the nut 56*a* is in alignment with the clevis 71 of the bell crank 28*a* which positions the hydraulic cylinder 58*a* substantially normal with respect to both the jackscrew 40 and the inboard arm 32 of the bell crank 28*a*. In other words, the hydraulic cylinder 58*a* is positioned transverse with respect to the jackscrew 40 and the hull 16. This normal or transverse relationship is best seen in FIG. 6, wherein it will be readily apparent that clevis 71 of the bell crank 28*a* is positioned at the furthest possible distance from the jackscrew 40 when the cylinder 58*a* is in the retracted position. Since the distance between the attached opposite ends of the hydraulic cylinder 58*a* is fixed, in the retracted position thereof, rearward movement of the nut 56*a* as described above will reposition the cylinder from the normal or transverse position and cause it to become angularly disposed between the jackscrew 40 and the inboard arm 32 of the bell crank 28*a*, and such repositioning will move the clevis 71 of the bell crank 28*a* closer to the jackscrew 40. The only way that the clevis 71 of the bell crank 28*a* can move closer to the jackscrew 40 is for the bell crank 28*a* to pivot about the longitudinal axis of the shaft 22, and such a pivot movement results in the hull 16 being moved from the midposition thereof to the retracted position. Such movement along with the relative positions of the nut 56*a*, cylinder 58*a*, bell crank 28*a* and the hull 16 is shown in FIG. 5 wherein the midposition thereof is illustrated in solid lines and the retracted position is fragmentarily shown in dashed lines.

It may now be apparent that the first stage of the two stage actuatable hull extension means 36 is accomplished by the first selectively actuatable means when that means is actuated by the rotational driving of the jackscrews 38 and 40 which moves the hulls 14 and 16 in laterally opposite directions from their retracted positions to the midpositions thereof as hereinbefore described in detail.

The second stage, i.e., the second selectively actuatable means, of the two stage actuatable hull extension means 36 is accomplished by actuating the hydraulic cylinders 58, 58*a*, 62, and 62*a* when it is desired to laterally extend the hulls 14 and 16 in opposite directions from their midpositions to the fully extended positions thereof.

A conventional hydraulic system (not shown) of the type well known in the art is employed to simultaneously actuate the hydraulic cylinders 58, 58*a*, 62, and 62*a*. The actuation of hydraulic cylinder 58*a* is shown best in FIG. 6, and the following description of the actuation of that cylinder and the results thereof is to be understood to apply to the other cylinders 58, 62, and 62*a* as well.

Upon actuation of the hydraulic cylinder 58*a*, the piston rod 68 thereof will be moved to its fully extended position which, of course, increases the distance between the attached opposite ends of that cylinder. Extension of the rod 68 of the cylinder 58*a* will push the clevis 71 of the inboard arm 32 of the bell crank 28*a* away from the jackscrew 40, and that pushing movement results in the bell crank 28*a* being pivotably rotated about the longitudinal axis of the shaft 22. Rotation of the bell crank 28*a* in the direction produced by actuation of the hydraulic cylinder 58*a* will move the hull 16 from its midposition shown in solid lines in FIG. 6 to its fully extended position partially shown in dashed lines in the same figure.

Figure 8:
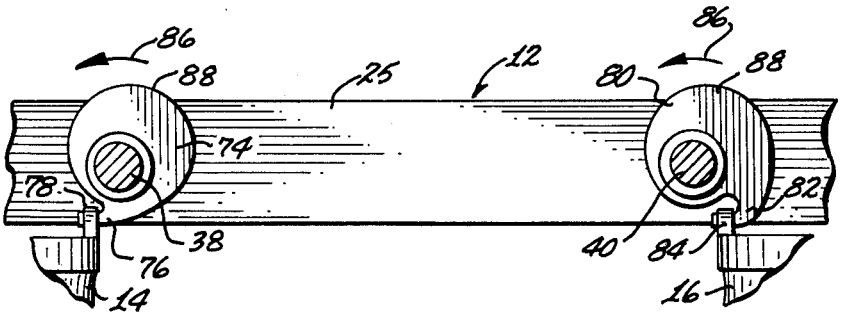
FIG. 8 is an enlarged fragmentary sectional view taken on the line 8—8 of FIG. 5.

Reference is now made to FIGS. 5 and 8 of the drawings wherein it will be seen that a cam 74 is provided on the unthreaded intermediate portion 50 of the jackscrew 38 and is fixedly mounted for rotation therewith. The cam 74 is formed with a hook shaped radially projecting lug 76 which is moved into latching engagement with an inverted U-shaped bracket 78 provided on the hull 14, when that hull is pivoted into the retracted position. Such latched engagement of the lug 76 with the bracket 78 secures the hull 14 in the retracted position to prevent unintentional extension thereof such as could possibly occur during trailering of the boat 10. A differently shaped cam 80 is similarly mounted on the unthreaded portion 50 of the jackscrew 40, and that cam 80 has a radially projecting hook shaped lug 82 thereon which moves into engagement with an inverted U-shaped bracket 84 to lockingly hold the hull 16 in the retracted position thereof.

Since the jackscrews 38 and 40 are coupled by means of the synchronizing means 44 for synchronous and simultaneous rotation, actuation of those jackscrews 38 and 40 to laterally extend the hulls 14 and 16 will cause the cams 74 and 80 to rotate in the direction indicated by the arrows 86 in FIG. 8. Such rotation will inititally and simultaneously disengage the lugs 76 and 82 from their respective brackets 78 and 84 and thereby free the hulls 14 and 16 for lateral extension as hereinbefore described.

Due to the angular disposition of the hydraulic cylinders 58, 58*a*, 62 and 62*a* when the hulls 14 and 16 are in the retracted position, as shown in dashed lines in FIG. 5, initial movement of the hulls toward the midpositions thereof requires that a considerable amount of force be employed. To reduce the amount of this force, each of the cams 74 and 80 are formed with a cam surface 88 which, upon rotation of the cams will move into direct engagement with their respective hulls 14 and 16 and will initiate the lateral extension thereof with a minimum amount of force.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A boat structure comprising:

a. a frame having a spaced pair of shafts interconnected by at least a pair of transverse beams;

b. a superstructure mounted atop said frame;

c. a pair of hulls each pivotably connected to a different one of the shafts of said frame for rotation about the longitudinal axes thereof, said hulls laterally pivotable in opposite directions from a retracted position to a midposition to a fully extended position; and d. actuatable hull pivoting means on said frame and connected to said pair of hulls for movement of said pair of hulls from the retracted to the midposition thereof and from the midposition to the fully extended position, said actuatable hull pivoting means comprising, first selectively actuatable means on said frame and connected to said pair of hulls for movement thereof through approximately 45° of rotation about their respective ones of the shafts of said frame to move said pair of hulls from the retracted position to the midposition thereof, and second selectively actuatable means on said frame and connected to said pair of hulls for movement thereof through approximately 45° degrees of rotation about their respective ones of the shafts of said frame to move said pair of hulls from the midposition to the fully extended position thereof.

2. A boat structure as claimed in claim 1 wherein said first selectively actuatable means comprises:

a. a pair of jackscrews journaled for axial rotation on said frame, said pair of jackscrews spaced apart and parallel with respect to each other and parallel with respect to the shafts of said frame;

b. at least a pair of internally screw threaded nuts each mounted on a different one of said jackscrews for movement therealong upon axial rotation of said jackscrews; and c. means coupling each of said pair of nuts with a different one of said pair of hulls for pivotably moving said hulls to their retracted position when said nuts are moved in one direction along their respective ones of said jackscrews and for pivotably moving said hulls to their midposition when said nuts are moved in the opposite directions along their respective ones of said pair of jackscrews.

3. A boat structure as claimed in claim 2 wherein said pair of jackscrews have synchronizing means interconnectingly mounted thereon for synchronization of the axial rotation thereof.

4. A boat structure as claimed in claim 2 wherein at least one of said pair of jackscrews has a drive means coupled thereto for axial rotation thereof.

5. A boat structure as claimed in claim 1 wherein said first selectively actuatable means comprises:

a. a spaced pair of jackscrews journaled for axial rotation on said frame and disposed in parallel relationship with respect to each other and with respect to the shafts of said frame;

b. at least a pair of internally screw threaded nuts each mounted on a different one of said pair of jackscrews for movement therealong upon axial rotation of said jackscrews; and c. means for coupling each of said pair of nuts with a different one of said pair of hulls with said means for coupling substantially transversely extending therebetween when said nuts are moved to one end of their travel along their respective ones of said jackscrews for pivotably moving said pair of hulls to the midposition thereof, and angularly extending therebetween when said nuts are moved toward the other end of their travel along their respective ones of said jackscrews for pivotably moving said pair of hulls toward their retracted position.

6. A boat structure as claimed in claim 1 wherein said second selectively actuatable means comprises at least a pair of longitudinally extendable means each interconnected between said frame and a different one of said pair of hulls, each of said pair of longitudinally extendable means having a retracted position which holdingly positions said pair of hulls in the midposition thereof and having an extended position which holdingly positions said pair of hulls in the fully extended position thereof.

7. A boat structure as claimed in claim 6 wherein each of said pair of longitudinally extendable means comprises a hydraulic cylinder.

8. A boat structure comprising:

a. a frame lhaving a spaced pair of shafts interconnected by at least a pair of transverse beams;

b. a superstructure mounted atop said frame;

c. a pair of hulls each pivotably connected to a different one of the shafts of said frame for axial rotation about the longitudinal axes thereof, said hulls laterally pivotable in opposite directions from a retracted position to a midposition to a fully extended position;

d. A pair of jackscrews journaled for axial rotation on said frame, said jackscrews parallel with respect to each other and with respect to the shafts of said frame;

e. at least a pair of nuts each mounted on a different one of said jackscrews and movable therealong upon rotation of said jackscrews;

f. means for connecting each of said pair of nuts with a different one of said pair of hulls with said means movable from an angular orientation to a transverse orientation therebetween upon movement of said nuts along said jackscrews, the movement of said means from the angular to the transverse orientation thereof pivotably moving said pair of hulls from the retracted to the midposition thereof; and g. said means being longitudinally extendable for pivotably moving said pair of hulls from the midposition to the fully extended position thereof.

9. A boat structure as claimed in claim 8 and further comprising means connected to said pair of jackscrews for synchronized axial rotation thereof.

10. A boat structure as claimed in claim 8 and further comprising means mounted on each of said pair of jackscrews and rotatable therewith for latchingly engaging said pair of hulls when said hulls are pivotably moved into the retracted position.

11. A boat structure as claimed in claim 8 and further comprising a pair of cam means each mounted on a different one of said pair of jackscrews for rotation therewith into engagement with said pair of hulls when said pair of hulls are to be pivotably moved from the retracted to the midposition thereof.

12. A boat structure as claimed in claim 8 wherein said means for connecting each of said pair of nuts with a different one of said pair of hulls comprises a hydraulic cylinder for each of those connections, each of said hydraulic cylinders being pivotably connected on one end thereof to its respective one of said nuts and on the other end thereof to its respective one of said pair of hulls.

* * * * *